United States Patent [19]

Tierney

[11] 4,351,303

[45] Sep. 28, 1982

[54] MANUALLY ADJUSTABLE VALVE MEANS FOR AN EXHAUST GAS RECIRCULATION SYSTEM

[76] Inventor: Raymond J. Tierney, 1911 Longview Dr., New Brighton, Minn. 55112

[21] Appl. No.: 189,376

[22] Filed: Sep. 22, 1980

[51] Int. Cl.[3] ..... F02M 25/06

[52] U.S. Cl. ..... 123/568; 123/572

[58] Field of Search ..... 123/568, 570, 572, 585, 123/586, 587

[56] References Cited

U.S. PATENT DOCUMENTS

| | | | |
|---|---|---|---|
| 1,338,398 | 4/1920 | Richards | 123/587 |
| 2,456,213 | 12/1948 | Pelc | 123/568 |
| 3,842,814 | 10/1974 | Bier | 123/568 |
| 3,913,541 | 10/1975 | Scott, Sr. | 123/585 |
| 3,923,024 | 12/1975 | Dabrio | 123/587 |
| 3,990,420 | 11/1976 | Bitterman | 123/587 |
| 3,996,315 | 12/1976 | Herail | 123/585 |
| 4,240,145 | 12/1980 | Yano et al. | 123/587 |
| 4,278,063 | 7/1981 | Nakamura et al. | 123/587 |

*Primary Examiner*—Wendell E. Burns

[57] ABSTRACT

An improvement to an interval combustion engine having an exhaust gas recirculation system which comprises a negative pressure line from the carburetor communicating with valve means to control the amount of recycled exhaust, the improvement being provided by manually operated valve means inserted in the negative pressure line. This manually operated valve means has an inlet port open to the atmosphere and manual adjusting means to control the size of the inlet port, to thereby minimize recycling of excessive amounts of exhaust gas which can result in inefficient engine operation.

5 Claims, 2 Drawing Figures

MANUALLY ADJUSTABLE VALVE MEANS FOR AN EXHAUST GAS RECIRCULATION SYSTEM

BACKGROUND OF THE INVENTION

The present invention relates to an internal combustion gasoline engine having an exhaust gas recirculating system therein, and means to provide more trouble-free operation thereof.

Since the early 1960's, large-scale efforts have been undertaken by the automobile industry to control automotive emissions from internal-combustion engines. Initial efforts dealt with the installation of a positive crank case ventilation system (PCV). This system reduces hydrocarbon emissions by circulating fresh air down through the crank case to pick up blowby gases, which are then re-routed through the carburetor and into the combustion chamber, whereupon they will be burned prior to being expelled through the exhaust system.

The next attempt at reducing automotive emissions resulted in the air injection system, wherein oxygen-rich air from the atmosphere is injected into the exhaust manifold of the engine to insure combustion of unburned hydrocarbons before they are expelled as exhaust. Later, a thermostatically controlled air cleaner system was introduced, wherein air entering the conventional air cleaner was heated to raise the combustion temperature of a cold engine, thereby reducing hydrocarbon emissions by improving engine efficiency during warmup of the engine.

The most recent emission system is the exhaust gas recirculation system (EGR). This system is designed to reduce nitrogen oxide emissions by recirculating exhaust gases into the intake manifold to dilute the fuel charge, which thereby reduces peak flame temperature. The EGR's operation has as its main component a vacuum-operated valve, which is designed to emit more and more exhaust gas into the intake manifold as the speed of the engine, and thus the vacuum created thereby, increases. The vacuum sensing line of the EGR is typically connected to the carburetor venturi, and as engine speed is increased, the pressure is lowered at or near the carburetor venturi, which is transmitted to the EGR via the vacuum sensing line. Sensing the lowered pressure, the EGR valve opens, thereby allowing more exhaust gas to be recirculated back through the intake manifold, reducing the ultimate emission of pollutants.

The problems with such a system is that many EGR's recirculate an excessive amount of exhaust gas, thereby causing the automobile to hesitate, surge, and, in some instances, to cease operation, resulting in great fuel waste.

I have now found an uncomplicated device which the average automobile owner can install in the above system to allow for adjustment of the EGR operation such that the automobile will not run poorly.

SUMMARY OF THE INVENTION

In accordance with the invention there is provided an improvement to an exhaust gas recirculation (EGR) system for an internal combustion engine. The EGR system contains a negative pressure line from the carburetor which communicates with valve means to control the amount of exhaust gas recycled to the intake manifold in accordance with the pressure variation in the negative pressure line, and the improvement comprises manually adjustable valve means inserted in the negative pressure line having at least one outlet port open thereto and an inlet port open to the atmosphere together with manual adjusting means to control the size of the inlet port.

This improvement can effectuate a reduced signal to the EGR valve, thereby reducing the amount of exhaust gas recycled and smoothing out engine operation.

DETAILED DESCRIPTION OF THE DRAWING

Figure 1:
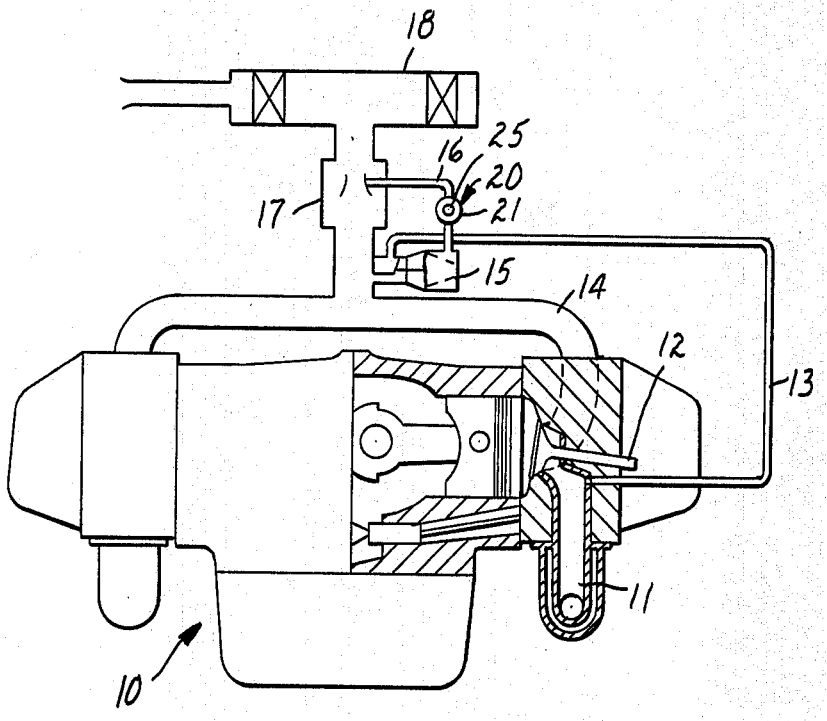
FIG. 1 illustrates a conventional internal combustion engine having an EGR system utilized therewith.

In FIG. 1 there is illustrated a typical internal combustion engine 10 having exhaust manifold 11, intake manifold 14, a conventional carburetor 17 and intake air cleaner 18. Attached to the intake manifold 14 is shown an EGR valve 15 having intake exhaust line 13 which is connected from EGR valve 15 to exhaust manifold 11, and vacuum sensing line 16 which is connected from the carburetor 17 to the EGR valve 15. Inserted in vacuum sensing line 16 is the valve means 20 of my invention, a preferred embodiment of which is illustrated in FIG. 2.

Figure 2:
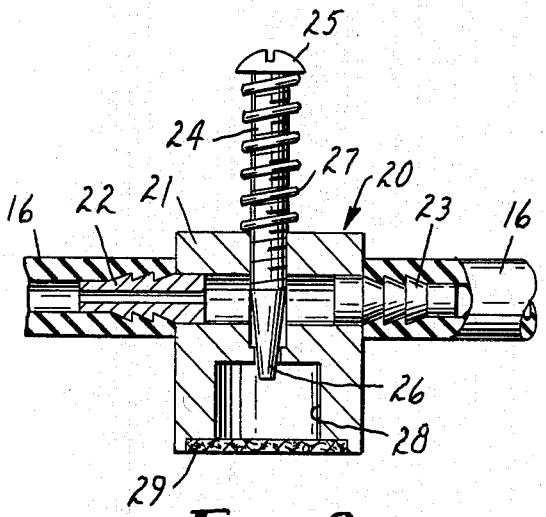
FIG. 2 illustrates the preferred valve means of my invention which can allow for manual adjustment by the automobile operator to insure smooth engine operation relative to the EGR system operation.

The transverse sectional view of FIG. 2 illustrates valve means 20, comprising a housing 21 having outlet attachment ports 22 and 23 for convenient insertion into vacuum sensing line 16 and inlet port 28 which is open to the atmosphere. The upper portion of housing 21 has a threaded hole for engagement with threaded adjustment screw 25, illustrated as having a slotted head for engagement with a conventional screwdriver. Adjustment screw 25 has a threaded shaft 24 extending into housing 21 and has a tapered base 26 for engagement with the valve seat contained in inlet port 28. With this arrangement, there is a linear change in the negative pressure line 16 responsive to operation of adjustment screw 25.

Preferably, filter means 29 is attached to inlet port 28 to prevent contaminants from entering the system. Such can be a felt pad or similar material which can be glued over inlet port 28. Also preferably, compression spring 27 is positioned on shaft 24 to secure the positioning of adjustment screw 25 once adjustment is made.

Housing 21 can be manufactured from metal, such as aluminum or steel, rigid plastic, etc. Adjustment screw 25 can be made from conventional screws by modifying same to provide for tapered base 26.

Valve means 20 can be inserted in the EGR vacuum sensing line 16 by a number of convenient ways, the preferred being as shown in FIG. 1, and described above, wherein the valve means contains outlet ports 22 and 23 which are adapted for insertion into vacuum sensing line 16 at a convenient location where same may be cut in two.

The size of valve means 20 can vary depending on the size and type of automobile, vacuum sensing line size, etc.

When an internal combustion engine containing an EGR system begins to run very rough, because of the large circulation of exhaust gases, the engine operator can simply open adjustment screw 25 on valve means 20 to thereby allow greater amounts of atmospheric air in the vacuum sensing line to the EGR. This will cause a reduced signal to the EGR valve, which will thereby become more closed to allow circulation of less exhaust gas into the carburetion system, thereby tending to smooth out the operation of the engine.

The valve means can be adjusted to the point where rough engine operation ceases and smoother running occurs.

What is claimed is:

1. In an exhaust gas recirculation system for an internal combustion engine, wherein said exhaust gas recirculation system contains a negative pressure line from a carburetor communicating with valve means to control the amount of exhaust gas recycled to an intake manifold in accordance with the pressure variation in said negative pressure line, the improvement comprising a manually adjustable valve means inserted in said negative pressure line, said manually adjustable valve means having an inlet port open to the atmosphere and at least one outlet port open to said negative pressure line, and manual adjusting means to control the size of said inlet port.

2. The system of claim 1 wherein said manually adjustable valve means comprises a housing having two outlet ports adapted for insertion into said negative pressure line, an inlet port open to the atmosphere, and a threaded hole in the upper portion thereof adapted to receive a threaded adjustment screw, said screw having a tapered base adapted to communicate with said inlet port to control the size thereof.

3. The system of claim 2 wherein said threaded adjustment screw has a compression spring associated therewith adapted to maintain the position of said adjustment screw.

4. The system of claim 2 wherein said inlet port has filter means associated therewith to prevent entrance of contaminants in said negative pressure line.

5. The system of claim 4 wherein said filter means comprises a felt pad fixed to the outside face of said inlet port.

* * * * *